US005329668A

United States Patent [19]

Schlichter

[11] Patent Number: 5,329,668

[45] Date of Patent: Jul. 19, 1994

[54] METHOD AND APPARATUS FOR DETACHING AND MIXING FIBER TUFTS

[75] Inventor: Stefan Schlichter, Viersen, Fed. Rep. of Germany

[73] Assignee: Trützschler GmbH & Co. KG, Mönchengladbach, Fed. Rep. of Germany

[21] Appl. No.: 897,056

[22] Filed: Jun. 11, 1992

[30] Foreign Application Priority Data

Jun. 12, 1991 [DE] Fed. Rep. of Germany ..... 4119351

[51] Int. Cl.[5] ..... D01B 1/00

[52] U.S. Cl. ..... 19/97.5; 19/80 R; 19/145.5; 198/433

[58] Field of Search ..... 19/80 R, 97.5, 65 A, 19/145.5; 198/418.1, 418.2, 433

[56] References Cited

U.S. PATENT DOCUMENTS

| | | | |
|---|---|---|---|
| 3,381,341 | 5/1968 | Platt et al. | 19/80 R |
| 4,273,489 | 6/1981 | Lingl, Jr. et al. | 198/418.2 |
| 4,723,344 | 2/1988 | Leifeld . | |
| 4,888,857 | 12/1989 | Pinto et al. | 19/80 R |
| 4,979,272 | 12/1990 | Demuth et al. . | |
| 5,025,533 | 6/1991 | Faas et al. | 19/80 R |

FOREIGN PATENT DOCUMENTS

| | | | |
|---|---|---|---|
| 919118 | 1/1973 | Canada | 198/433 |
| 362538 | 4/1990 | European Pat. Off. | 19/80 R |
| 2310845 | 12/1977 | Fed. Rep. of Germany . | |
| 3535763 | 4/1985 | Fed. Rep. of Germany . | |
| 3919746 | 12/1990 | Fed. Rep. of Germany . | |
| 3924779 | 1/1991 | Fed. Rep. of Germany . | |
| 481230 | 12/1969 | Switzerland . | |
| 1335582 | 9/1987 | U.S.S.R. . | |
| 1481278 | 5/1989 | U.S.S.R. . | |
| 946333 | 1/1964 | United Kingdom . | |
| 1150863 | 5/1969 | United Kingdom . | |
| 1216148 | 12/1970 | United Kingdom . | |

OTHER PUBLICATIONS

Hösel, "Mikrocomputersteuerung für die Ballenabtragung" Internationales Textil-Bulletin Garnherstellung Mar. 1986, pp. 9, 12, 13, 16, 19, 22.

*Primary Examiner*—Clifford D. Crowder
*Assistant Examiner*—Michael A. Neas
*Attorney, Agent, or Firm*—Spencer, Frank & Schneider

[57] ABSTRACT

An apparatus for mixing fiber tufts includes a first conveyor for accommodating thereon a row of fiber bales; a bale opener for travelling along the row of fiber bales and removing fiber tufts sequentially from the fiber bales; a storage system for storing a plurality of fiber bales each containing fiber of predetermined properties; a selecting device for selecting fiber bales of desired properties from the fiber bales accommodated in the storage system; and a second conveyor for sequentially advancing the selected fiber bales from the storage system to the first conveyor for complementing the row of fiber bales accommodated on the first conveyor for obtaining a series of fiber bales thereon having preselected, determined properties.

10 Claims, 2 Drawing Sheets

METHOD AND APPARATUS FOR DETACHING AND MIXING FIBER TUFTS

BACKGROUND OF THE INVENTION

This invention relates to a method and an apparatus for removing fiber tufts from fiber bales of different origins and for mixing the detached fiber tufts, such as cotton, chemical fiber or the like. For the detaching operation the fiber bales are assembled into at least one transportable group (row).

According to a known method a plurality of bale groups are provided, each composed of a plurality of fiber bales. The fiber material is removed (detached) from the bales of the individual groups and is subsequently blended in a downstream-arranged mixing apparatus. The fiber bales are arranged in groups; within each group the fiber material is of the same origin. Stated differently, all the fiber bales within any individual group contain fiber of identical properties. The fibers of different groups are, as individual components, conveyed pneumatically to the mixing apparatus through transporting ducts and are intermingled for the first time in such mixer. The several bale series or bale groups each form a mixing component. The composition of the blend in the mixer is varied by changing the proportion of the fiber components from the individual groups as the blend is prepared.

It is a disadvantage of the above-outlined process that for each group a separate fiber bale opening device has to be provided, that is, the number of the fiber bale openers corresponds to the number of the different fiber origins. It is a further disadvantage of the conventional method that the various detaching processes have to be controlled differently, as a result of which the opening devices of the bale opener are periodically idle which is inefficient and uneconomical and may lead to operational disturbances in case of breakdown.

SUMMARY OF THE INVENTION

It is an object of the invention to provide an improved method and apparatus of the above-outlined type from which the discussed disadvantages are eliminated and which, in particular, makes possible in a simple manner the detaching and blending of fiber tufts and a variation of the blend.

This object and others to become apparent as the specification progresses, are accomplished by the invention, according to which, briefly stated, the fiber bales are, for performing the detaching operation thereon, arranged into at least one fiber bale group (row) which has different but predetermined fiber properties and further, to each such group new fiber bales having predetermined fiber properties may be added in a controlled, variable manner.

By virtue of the fact that according to the invention the fiber bale group which is about to undergo a detaching (fiber tuft removing) operation, is composed of fiber bales having different fiber properties, there is obtained a blending of different fibers by the detaching operation itself. Thus, each such bale group is opened by a single fiber tuft detaching device which, in addition to the detaching operation, is performing a mixing operation as well. In order to vary the blend, at least one fiber bale having different fiber properties is added to the bale group from the bale storage in a simple manner. In this manner, the mixing of the fiber tufts is realized as early as the fiber detaching operation and the alteration of the mixing may be effected with simple means.

The method according to the invention has the following additional advantageous features:

The row of the fiber bales worked on by the bale opener is assembled as a function of predetermined and/or sensed actual property data of a subsequently made intermediate product such as a sliver and/or a subsequently made final product such as a yarn, and in case of deviations from a desired value, an immediate and automatic correction is performed.

The fiber bales are assembled in a fiber bale storage area into groups wherein each group has fiber bales of identical, predetermined properties and from which at least one fiber bale is periodically added to the bale row worked on by the bale opener.

The fiber bales are assembled in a fiber bale storage area in preselected groups according to predetermined properties.

The fiber bales are placed in an automatic bale storing apparatus, such as a vertical bale stand and are identifiable by means of bar codes.

The properties of the intermediate product or end product are automatically determined by on-line testing.

The properties of the intermediate product or the end product are determined semi-automatically.

The properties of the intermediate product or the end product are determined by random testing.

The determined property is the fineness of fiber.

The determined property is the color of the fiber.

The determined property is the content of impurities.

The determined properties are the content of neps, seed coats, and/or trash particles.

The determined property is the uniformity of the silver or yarn.

The determined properties are yarn defects.

The determined properties are imperfections in the yarn.

The determined property is the yarn strength.

The determined property is the fiber length.

For each value characterizing a property a limit interval is determined and a fiber bale of different properties is added to the bale row in case the sensed property of the finished product or the intermediate product is outside the predetermined limit.

The predetermined properties of the individual fiber bales are determined by random testing.

The predetermined properties of each fiber bale are determined by random testing.

The properties of the individual bales are determined based on test certificates.

The predetermined properties of the fiber bales are stored in a data memory.

The apparatus according to the invention has the following additional advantageous features:

The bale opener has an opening (detaching) device which is oriented obliquely in such a manner that the fiber tufts are detached from the top surfaces of the fiber bales at an inclined angle to the horizontal.

The bale transporting device for advancing fiber bales to the bale row worked on by the bale opener comprises conveyor belts.

The bale transporting device for the bales to be advanced to the bale row worked on by the bale opener has at least one bale transport carriage.

More than one fiber tuft detaching devices are provided with which there are associated a bale transporting and distributing apparatus.

The apparatus for determining the properties of the intermediate product or the end product, the conveyor device for accommodating the row of fiber bales to be worked on by the bale opener, and the bale transporting device for the bales in the bale storage area are connected to a common electronic control and regulating device.

The control and regulating device is connected to a memory containing data on predetermined properties of the fiber bales.

DESCRIPTION OF THE PREFERRED EMBODIMENTS

Figure 1A:
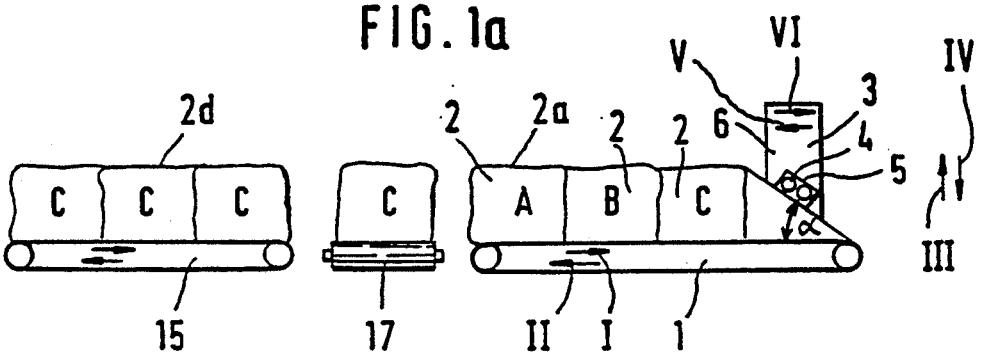
FIG. 1*a* is a schematic side elevational view of an apparatus for performing the method according to the invention.

Turning to FIG. 1*a*, there is illustrated therein a conveyor belt 1 which receives a group 2*a* formed of a plurality of fiber bales 2 from which fiber tufts are detached by a fiber tuft detaching device (bale opener) 3. The fiber bales 2 have different fiber properties (origins) A, B and C. Thus, the fiber bales 2 are assembled to form the fiber bale group 2*a* having different, yet predetermined fiber properties within the group. The upper and lower flights of the belt 1 travel in the direction indicated by the arrows I and II. The fiber bale opener 3 travels on rails (not shown) parallel to the fiber bale group 2*a*.

The fiber bale opener 3 may be, for example, a BLENDOMAT BDT 020, manufactured by Trützschler GmbH & Co. KG, Mönchengladbach, Germany. The fiber bale opener 3 has an opening (detaching) device 4 accommodated in a housing 5 cantilevered to a bale opener tower 6. The housing 5, together with the detaching device 4, is movable relative to the tower 6 in a vertical direction as indicated by the arrows III and IV. The bale opener 3 travels on non-illustrated rails along the fiber bale series 2*a* as indicated by the arrows V and VI. The cantilever housing 5, together with the opening (detaching) device 4 may be set into an oblique position by pivoting it about a horizontal axis arranged perpendicularly to the travelling direction V, VI so that the bale opener removes fiber tufts along an oblique top bale face which is arranged at an angle $\alpha$ to the horizontal. The removed fiber tufts are conveyed away from the bale opening apparatus 3 by non-illustrated suction devices and are admitted to an after-connected mixer which may be, for example, an MPM MULTIMIXER model, manufactured by Trützschler GmbH & Co. KG and in which an additional blending of the fiber tufts takes place. The mixer 7 may be followed by a cleaner 8 and a carding machine 9 which may be, respectively RST and EXACTACRD models, manufactured by Trützschler GmbH & Co. KG.

Figure 2:
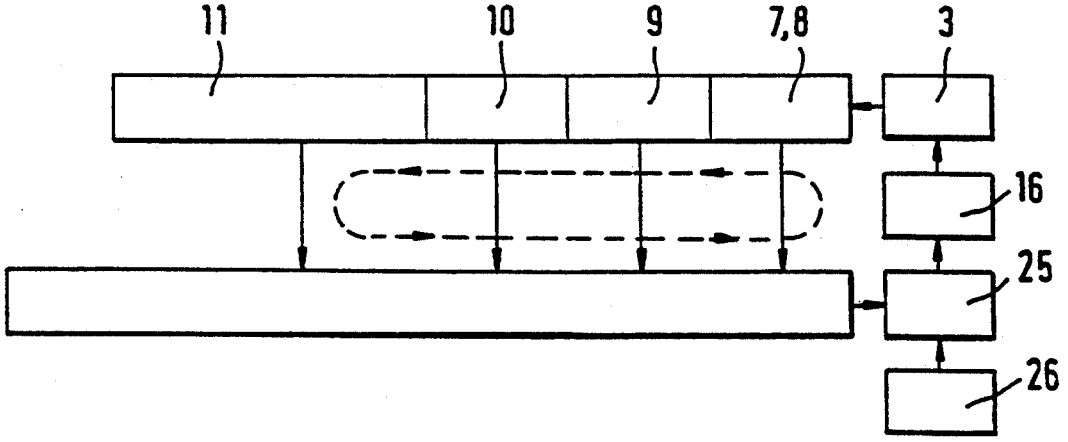
FIG. 2 is a block diagram illustrating the method according to the invention performed on a spinning line and including measuring components for quality measurements, control device and bale selecting and forwarding apparatus.

According to FIG. 2, downstream of the bale opener 3, the cleaning machines 7 and 8 and the card 9 there are arranged drafting frames 10 and spinning machines 11.

Figure 3:
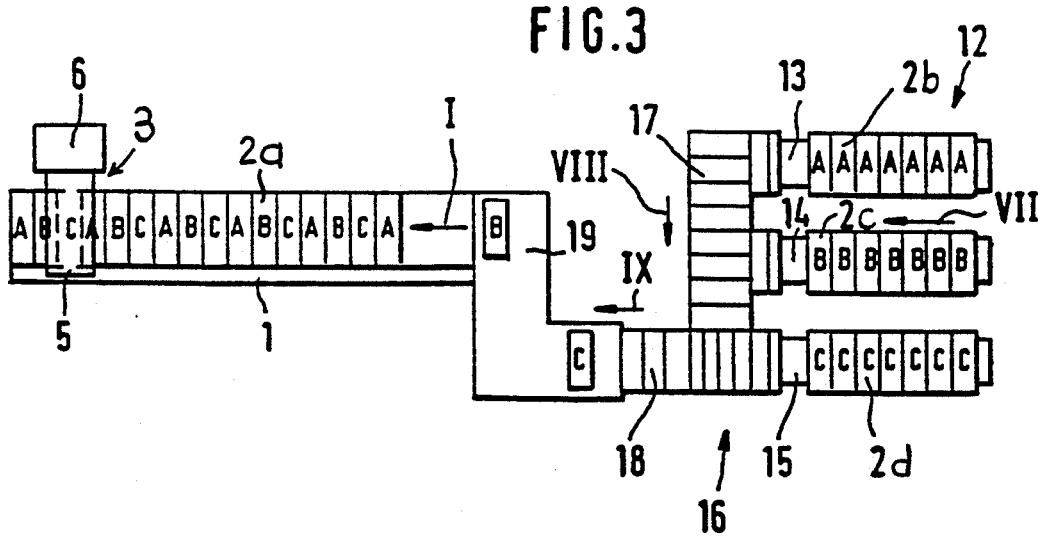
FIG. 3 is a schematic top plan view of a device for supporting a fiber bale group undergoing a fiber-detaching operation and a pre-positioned bale-selecting and bale-transporting device as well as bale storage.
Figure 4:
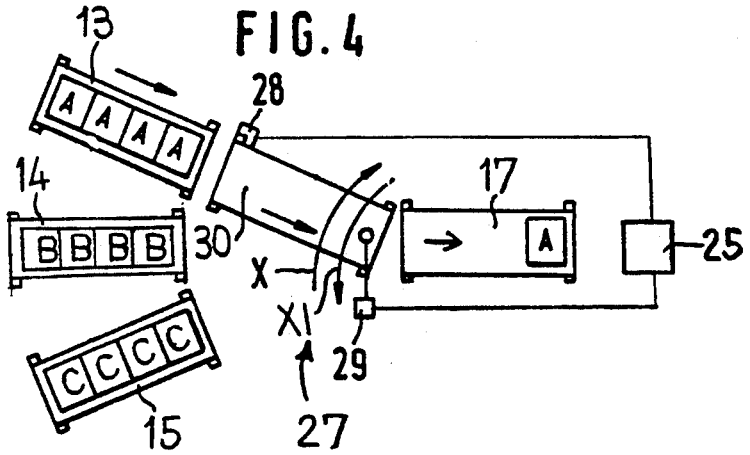
FIG. 4 is a schematic top plan view of details of a bale selecting device different from that shown in FIG. 3.

Turning to FIG. 3, in a bale storage zone 12 in the vicinity of the bale opener 3 parallel-spaced storage conveyors 13, 14 and 15 are provided, respectively supporting fiber bale groups 2*b*, 2*c* and 2*d*. The group 2*b* has only bales with fiber origin A, the group 2*c* has only bales with fiber origin B and the group 2*d* has only bales with fiber origin C. Between the conveyor belt 1 and the storage zone 12 (occupied by conveyors 13, 14 and 15) there is provided a bale selecting and conveying device generally designated at 16 formed of at least one conveyor belt assembly 17, 18. The apparatus 16 includes a selecting assembly 27 (such as shown in FIG. 4) for the fiber bales 2 which are advanced by the selecting assembly 27 selectively from the bale groups 2*b*, 2*c* or 2*d* to the conveyor belt 1. Between the conveyor belts 14 and 18 there is situated a non-illustrated device for automatically removing wrappers, straps or the like from the fiber bales 2. The fiber bales 2 are advanced on the conveyor belts 13, 14 and 15 in the direction of the arrow VII and are moved by the intermediate collecting conveyor belt 17 in the direction of the arrow VIII and on the conveyor belt 18 in the direction of the arrow IX.

Figure 1B:
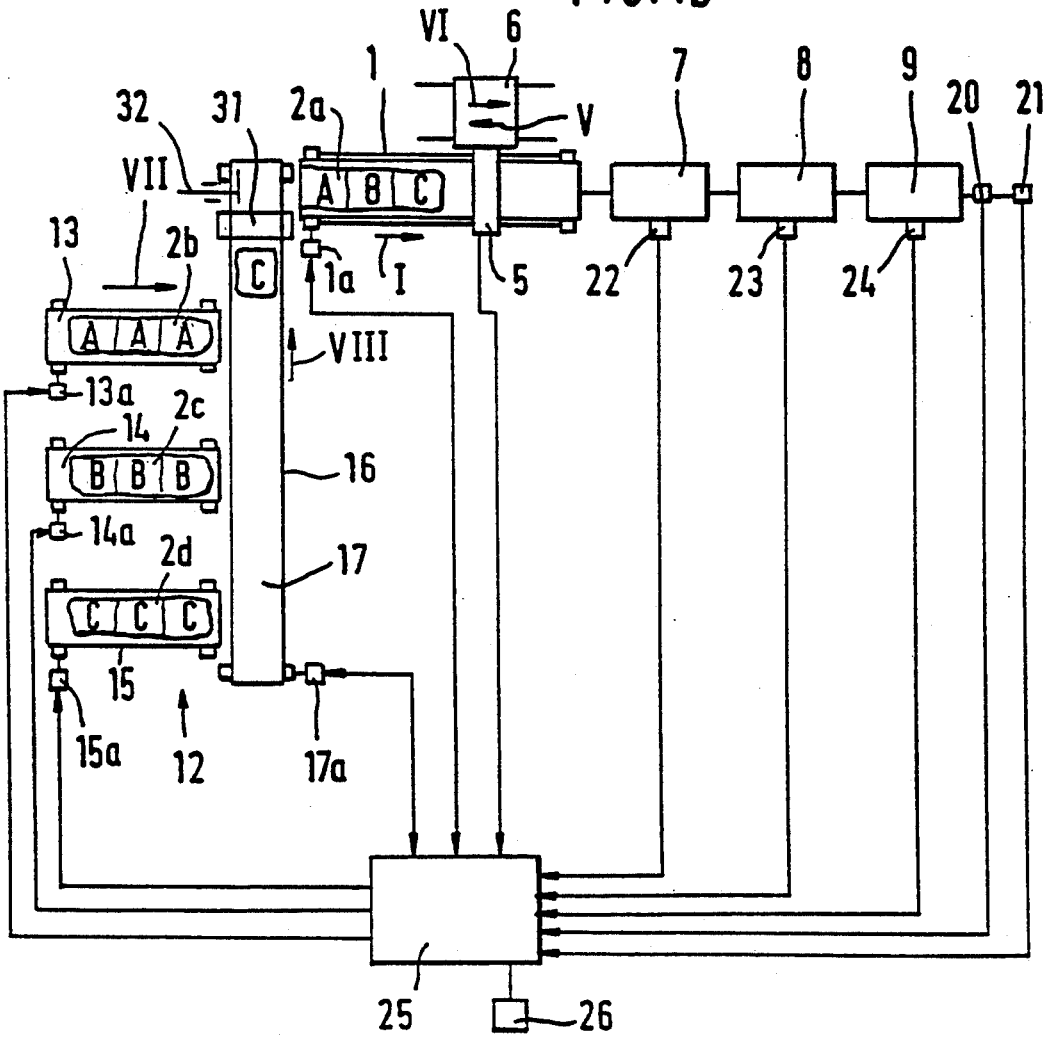
FIG. 1*b* is a schematic top plan view of the apparatus of FIG. 1*a*, illustrated with a block diagram of a control device.

Reverting to FIG. 1*b*, at the output of the carding machine 9 there are provided a sensor 20 for measuring the fineness of fiber and a color sensor 21 for testing the sliver outputted by the carding machine. With the mixer 7, the cleaner 8, the carding machine 9 and with other intermediate devices and machines which may be present in the processing line, there are associated additional sensors 22, 23 and 24 for determining various properties of the intermediate products, for example, fiber tufts. In a similar manner, non-illustrated sensors are provided for testing the quality and/or properties of the intermediate or end products of the drafting frames 10 or the spinning machines 11.

The sensors 21–24, a motor 1*a* for driving the conveyor belt 1, a motor 17*a* for driving the conveyor belt 17 as well as motors 13*a*, 14*a* and 15*a* for driving the respective belts 13, 14 and 15 are connected to a common microprocessor constituting a control and regulating device 25. A memory 26 is connected to the control and regulating device 25 for storing and inputting data on predetermined properties of the fiber bales 2. Further, the non-illustrated motors for propelling the bale opener 3 in the travelling direction V, VI and a lifting motor for raising the fiber detaching device 3 in the direction as indicated by the arrows III and IV are also connected to the regulating device 25.

Turning once again to FIG. 4, the bale selecting assembly 27 includes a conveyor 30 which at one end is pivotal about a vertical axis in the direction of arrows X and XI by a motor 29. As a result, the pivotal or discharge end of the conveyor 30 is at all times associated with the input end of the conveyor 17, whereas the input end of the conveyor 17 may be selectively aligned with the discharge end of the conveyor 13, 14 or 15. Motor 28 is provided to circulate the conveyor belt 30. Both motors 28 and 29 are likewise connected to the control and regulating device 25.

Thus, with the above-described systems, a predetermined mixing of the fiber bales of fiber property A, B and C can be achieved on the conveyor 1 by an appropriate selection, by the control device 25, of the fiber bales 2 from respective storage conveyors 13 (supporting fiber bales with properties A), 14 (supporting fiber bales with fiber properties B) and 15 (supporting fiber bales with properties C). By inputting manually or automatically the desired sequence of selection, a desired mixing of the bale sequence on the conveyor 1 may be achieved. Thus, for example, to obtain the sequence A, B, C on the conveyor belt 1 as shown in FIG. 1*b*, a simultaneous actuation of the conveyors 13, 14 and 15 will result in a simultaneous deposition of bales A, B and C on the momentarily stationary conveyor 17 on which thus a leading bale A, a mid bale B and a trailing bale C will be positioned. This sequence is maintained as the conveyor 17 is intermittently moved to align a respective fiber bale with and to transfer such bale to the conveyor 1 for replenishing the fiber bale series 2*a* worked on by the bale opener 3. A similar selection may be achieved with the selecting assembly 27 shown in FIG. 4, by sequentially aligning the swinging end of the conveyor belt 30 with conveyors 13, 14 or 15.

The desired sequence of the fiber bale types on the conveyor 1 is determined by a regulating circuit as a function of the quality of the end product of the processing line such as a yarn or as a function of selected qualities of intermediate products, such as slivers or fiber tufts.

The quality signals may be obtained automatically on-line, for example, by a nep sensor, semiautomatically or based on random sampling in a laboratory environment. The quality signals may represent the fineness of fiber, color, dirt content, neps, seed coats, trash particles, uniformity, yarn defects or imperfections, yarn strength and/or fiber length. For each quality-representing signal a limit interval may be determined and if the actual values deviate from such a limit interval, the bale sequencing (bale supply) will automatically change.

For all fiber types (origin of fiber) which are to be used in the blend, the following fiber data that are relevant for the end product are determined:

(a) by random sample analysis of individual bales under laboratory conditions; or (b) by random sample analysis of each bale under laboratory conditions; or (c) based on test certificates relating to the individual bales (for example, HVI test results).

The above bale data are stored, for example, as a data bank. Dependent upon the intensity of the testing as noted under (a), (b) and (c) above, bale groups down to the individual bales may be unequivocally defined.

The control device 25 combines the quality signals obtained from the process with pre-stored bale data for making the appropriate selection (sequencing) of the bales 2 to provide the subsequent bale to be added to the bale group supported on the conveyor belt 1 and submitted to a fiber tuft detaching operation by the bale opener 3.

The selection of the fiber bales based on the actual and desired quality data may be effected according to different principles and takes into consideration the relatively long delay prior to the actual engagement by the bale opener 3 until the generation of the signal representing the quality which dependent on the location of determination may vary. For example, according to a simple regulating principle for the use of the quality signals, their magnitude is smaller than the desired value. In such a case, the bale sequence is to be varied such that bales A should occur in the mixture by x% more frequently than previously. According to another type of regulation, a special expert-system may be used for the weighted evaluation of the deviating quality characteristics or, as the case may be, for affecting the same by the bale magnitudes.

The bale storage zone 12 may consist of a conventional bale storage system (that is, bale groups are being held at different locations), a preselected bale storage corresponding to the determined fiber data or an automatic bale storage system with corresponding selecting apparatus (for example, the bales are selected by quality by means of bar codes).

Apart from the embodiments described, the selecting apparatus for the fiber bales 2 and the transport for the bale opening device may be realized by a conveying or transport system, for example, a transverse band system with deflectors or a roller system with deflectors, an automatic transport system (for example, inductively guided) or a semiautomatic system with fork lift which delivers the fiber bales 2 in a sequence according to instruction lists.

In an apparatus where the fiber bales 2 are continuously (automatically) worked on by the detaching apparatus (for example, the opening device 4) along an oblique fiber bale surface, the bale supply and transport device 16 arranged upstream of the conveyor belt 1 advantageously includes a device 31 for removing bale ties such as wires, bands, straps and/or packaging from the fiber bales 2. The bale tie removing apparatus 31 is situated between the group of storage conveyors 13, 14, 15 and the conveyor belt 1.

According to an expedient embodiment, the bale supply and transport device comprises a driven pusher element for the fiber bales 2 which may be positioned on a roller track or on a stationary base such as a sheet metal track. The bale supply and transporting apparatus delivers the fiber bales continuously to the conveyor belt 1. Between the bale supply and transport apparatus and the conveyor belt 1 there is provided a bale displacement element 32, for example, a roller track, a transport belt, a driven pusher or the like which displaces the fiber bales 2 onto the conveyor belt 1 in a direction that is transverse to the conveying direction of the bale supply and transporting apparatus. In this manner the bales 2, pass through the device 31 for removing the bale ties and/or bale package in a continuous flow and are placed by the bale displacement element 32 onto the conveyor belt 1 where they join the trailing end face of the bale group 2*a* to become a part thereof.

An apparatus where fiber tufts are continuously detached from fiber bales along an inclined top bale surface is described, for example, in U.S. patent application Ser. No. 07/806,250 filed Dec. 31, 1991. An apparatus for removing bale ties such as wires, bands or straps and/or bale packaging is described in U.S. patent applications Ser. Nos. 07/745,201 and 07/745,211, both filed Aug. 15, 1991. These three US-applications are hereby incorporated by reference.

It will be understood that the above description of the present invention is susceptible to various modifications, changes and adaptations, and the same are intended to be comprehended within the meaning and range of equivalents of the appended claims.

What is claimed is:

1. An apparatus for mixing fiber tufts, comprising
(a) a first conveyor means for accommodating thereon a row of fiber bales;
(b) bale opener means for travelling along the row of fiber bales and removing fiber tufts sequentially from the fiber bales;
(c) storing means for storing a plurality of fiber bales each containing fiber of predetermined properties;
(d) selecting means for selecting fiber bales of desired properties from the fiber bales in said storing means; and
(e) a second conveyor means for sequentially advancing the selected fiber bales from said storing means to said first conveyor means for complementing said row of fiber bales accommodated on said first conveyor means for obtaining a series of fiber bales thereon having preselected, determined properties.

2. The apparatus as defined in claim 1, wherein said first conveyor means comprises an endless conveyor belt.

3. The apparatus as defined in claim 1, wherein said storing means comprises a plurality of conveyor belts each supporting a group of fiber bales and each having a discharge end; said selecting means and said second conveyor means comprising a selecting conveyor belt having an input end and means for selectively moving the input end of said selecting conveyor belt to the discharge end of a selected conveyor belt of said storing means for transferring from said storing means a bale of desired properties to said selecting conveyor belt; said selecting conveyor belt further having a discharge end cooperating with said first conveyor means for transferring a fiber bale from said selecting conveyor belt to said first conveyor means.

4. The apparatus as defined in claim 1, in combination with a fiber processing machine receiving the fiber tufts from said bale opener means and discharging a processed fiber product; the apparatus further comprising a property sensing means for emitting signals representing a property of the product discharged by said fiber processing machine.

5. The apparatus as defined in claim 1, in combination with a fiber processing machine receiving the fiber tufts from said bale opener means and discharging a processed fiber product; the apparatus further comprising a property sensing means for emitting signals representing a property of the product discharged by said fiber processing machine; and a control and regulating means connected to said property sensing means, said first conveyor means, said storing means, said selecting means and said second conveyor means for supplying fiber bales of desired properties to said first conveyor means as a function of a property of the product discharged by said fiber processing machine.

6. The apparatus as defined in claim 5, further comprising memory means connected with said control and regulating means for storing data on predetermined properties of the fiber bales.

7. The apparatus as defined in claim 5, wherein said storing means comprises a plurality of conveyor belts each supporting a group of fiber bales and each having a discharge end; said selecting means and said second conveyor means comprising a selecting conveyor belt having an input end and means for selectively moving the input end of said selecting conveyor belt to the discharge end of a selected conveyor belt of said storing means for transferring from said storing means a bale of desired properties to said selecting conveyor belt; said selecting conveyor belt further having a discharge end cooperating with said first conveyor means for transferring a fiber bale from said selecting conveyor belt to said first conveyor means; further comprising a drive motor connected to said selecting conveyor belt for circulating said selecting conveyor belt to advance fiber bales supported thereon to said first conveyor means; said means for selectively moving said intake end of said selecting conveyor belt includes an additional drive motor; said drive motor and said additional drive motor being connected to said control and regulating means.

8. The apparatus as defined in claim 1, in combination with a bale tie removing apparatus situated at said second conveyor means between said storing means and said first conveyor means for removing bale ties from the fiber bales situated on said second conveyor means.

9. The apparatus as defined in claim 1, further comprising a bale displacement element situated at said second conveyor means for transferring the fiber bales from said second conveyor means to said first conveyor means.

10. A method of removing fiber tufts from fiber bales, comprising the following steps:
(a) establishing identifiable groups of fiber bales, wherein the fiber bales within each group have identical, determined fiber properties and wherein the properties are different in each group;
(b) composing a row of fiber bales of predetermined, selected fiber properties;
(c) detaching fiber tufts in sequence from the fiber bales of said row;
(d) variably selecting further fiber bales from selected said groups, including the step of determining a limit interval for the fiber properties of each group; and
(e) consecutively adding the further fiber bales to said row, including the step of adding a fiber bale of different property when said limit is exceeded.

* * * * *